US008906480B2

(12) United States Patent
Fiutak et al.

(10) Patent No.: US 8,906,480 B2
(45) Date of Patent: Dec. 9, 2014

(54) REINFORCED LAMINATED SUPPORT MAT

(71) Applicant: Anthony Hardwood Composites, Inc., Sheridan, AR (US)

(72) Inventors: Jon C. Fiutak, Cape Elizabeth, ME (US); Toby Q. Edwards, Bryant, AK (US); Douglas R. Medlin, Leola, AK (US)

(73) Assignee: Anthony Hardwood Composites, Inc., Sheridan, AR (US)

( * ) Notice: Subject to any disclaimer, the term of this patent is extended or adjusted under 35 U.S.C. 154(b) by 233 days.

(21) Appl. No.: 13/705,953

(22) Filed: Dec. 5, 2012

(65) Prior Publication Data

US 2014/0154462 A1 Jun. 5, 2014

(51) Int. Cl.

| | |
|---|---|
| ***B32B 3/10*** | (2006.01) |
| ***E01C 9/08*** | (2006.01) |
| ***E01C 5/14*** | (2006.01) |

(52) U.S. Cl.

CPC ..... *E01C 5/14* (2013.01)
USPC ..... 428/54

(58) Field of Classification Search

CPC ..... E01C 9/086; E04C 2/14
USPC ..... 428/54; 404/35
See application file for complete search history.

(56) References Cited

U.S. PATENT DOCUMENTS

| | | | |
|---|---|---|---|
| 3,325,037 | A | 6/1967 | Kohn et al. |
| 3,447,996 | A | 6/1969 | Himmelheber et al. |
| 3,905,172 | A | 9/1975 | Blackburn |
| 4,078,348 | A | 3/1978 | Rothman |
| 4,271,649 | A | 6/1981 | Belanger |
| 4,312,908 | A | 1/1982 | Jasperson |
| 4,533,589 | A | 8/1985 | Sewell |
| 4,784,887 | A | 11/1988 | Abendroth |
| 4,801,483 | A | 1/1989 | Beckerman et al. |
| 4,932,178 | A | 6/1990 | Mozingo |
| 4,965,973 | A | 10/1990 | Engebretsen |

(Continued)

FOREIGN PATENT DOCUMENTS

| | | | |
|---|---|---|---|
| CH | 663980 | A5 | 1/1988 |
| EP | 1199139 | A | 4/2002 |

(Continued)

OTHER PUBLICATIONS

Acceptance Criteria for Structural Composite Lumber, ICBO Evaluation Service, Inc., Copyright 2002.

(Continued)

*Primary Examiner* — Alexander Thomas
(74) *Attorney, Agent, or Firm* — MacMillan, Sobanski & Todd, LLC

(57) ABSTRACT

A support mat includes a plurality of vertically oriented individual wood members adhesively bonded to each other, each of the individual wood members having wide faces oriented parallel to a direction of a load applied to the support mat, the support mat having outboard wood members, the outwardly facing wide faces of the outboard wood members defining a wide face of the support mat. The support mat also includes least two protective edge members, each protective edge member having an inboard wide face, each of the at least two protective edge members positioned against one the wide faces of the support mat. At least two substantially rigid fasteners extend through and connect each of the protective edge members and adjacent wood members. The wood members, protective edge members, and fasteners define a substantially rigid support mat having a substantially planar wide face.

18 Claims, 6 Drawing Sheets

(56) References Cited

U.S. PATENT DOCUMENTS

| | | | |
|---|---|---|---|
| 5,002,105 | A | 3/1991 | Bodig |
| 5,087,149 | A | 2/1992 | Waller, Jr. |
| 5,097,558 | A | 3/1992 | Accorsi et al. |
| 5,282,692 | A | 2/1994 | McLeod |
| 5,305,568 | A | 4/1994 | Beckerman |
| 5,313,758 | A | 5/1994 | Willman et al. |
| 5,362,545 | A | 11/1994 | Tingley |
| 5,482,754 | A | 1/1996 | Crook |
| 5,565,257 | A | 10/1996 | Tingley |
| 5,603,134 | A | 2/1997 | Whipkey et al. |
| 5,736,218 | A | 4/1998 | Iwata et al. |
| 5,756,975 | A | 5/1998 | Harris et al. |
| 6,050,047 | A | 4/2000 | Covelli et al. |
| 6,214,428 | B1 | 4/2001 | Henderson |
| 6,224,704 | B1 | 5/2001 | Bassett et al. |
| 6,281,148 | B1 | 8/2001 | Dagher et al. |
| 6,592,962 | B2 | 7/2003 | Edwards |
| 7,137,226 | B2 | 11/2006 | Fiutak et al. |
| 7,818,929 | B2 | 10/2010 | Fiutak et al. |
| 2002/0188074 | A1 | 12/2002 | Parker et al. |
| 2003/0113162 | A1 | 6/2003 | Seaux et al. |
| 2003/0133751 | A1 | 7/2003 | Smith |
| 2004/0042851 | A1 | 3/2004 | Davis et al. |

FOREIGN PATENT DOCUMENTS

| | | | |
|---|---|---|---|
| JP | 10115026 | | 5/1998 |
| JP | 10237982 | | 9/1998 |
| WO | 2004005646 | A1 | 1/2004 |

OTHER PUBLICATIONS

Boise Cascade Engineered Wood Products Division, Versa-Lam Products, www.bcewp.com, Dec. 21, 2001.

Falk et al., Laminating Effects in Glued-Laminated Timber Beams, Journal of Structural Engineering, Dec. 1995, pp. 1857-1863.

Georgia-Pacific Engineered Lumber Products, G-P Laminated Veneer Lumber (LVL) retrieved from www.gp.com on Dec. 21, 2001, pp. 1-3.

Georgia-Pacific Engineered Lumber Products, G-P Lam 3000 Glulam Beams retrieved from www.gp.com on Dec. 21, 2001, pp. 1-2.

International Search Report, Application No. PCT/US 03/21541, dated Oct. 23, 2003.

Laminated Veneer Lumber, LVL, Overview of the Product, Manufacturing and Market Situation by Department of Forest Products Marketing, www.hochstrate.de/micha/reports/replvl.html, dated Jan. 30, 2003.

Lister Industries Ltd., Road Mats, www.listerindustries.com/road_mat.htm, dated Aug. 14, 2012, pp. 1-4.

Serrano et al., Numerical Investigations of the Laminating Effect in Laminated Beams, Journal of Structural Engineering, dated Jul. 1999, pp. 740-745.

Williamette, Laminated Veneer Lumber, LVL, StrucLam, www.wii.com/LVL1.html, dated Dec. 21, 2001.

Williamette, Building Materials by Engineered Wood Products, retrieved from www.wii.com on Dec. 21, 2001.

REINFORCED LAMINATED SUPPORT MAT

BACKGROUND OF THE INVENTION

Various embodiments of a laminated support mat are described herein. In particular, the embodiments described herein relate to an improved laminated support mat and a method of manufacturing such an improved laminated support mat.

The construction industry utilizes solid sawn wood and wood panel members in a variety of forms to aid in the erection of buildings, roads, and bridges. For example, temporary road panels and crane mats are often constructed using solid-sawn hardwood timbers or some species of softwoods. These panels are used to form a temporary lightweight roadway or foundation to facilitate vehicular and equipment travel as may be required in construction operations. Other industry users of such mats include users in the field of pipeline, utility, transportation, oil, and infrastructure.

As shown in FIG. 1, a conventional road panel, shown generally at 10, is formed by using a plurality of solid sawn timber elements 12. Typically, four pieces of solid sawn timber 12 are used, each having a cross-sectional dimension ranging from about 8 inches by 8 inches to about 12 inches by 12 inches, with a length of 16 feet. The four pieces of timber 12 are usually bolted together using bolts 14 to form the temporary road panel 10 having an assembled dimension of 4 feet by 1 foot by 16 feet. Several panels may be placed side by side over existing ground to form a temporary roadway or to support cranes on a construction site. Ground conditions under the panels vary greatly and may include, for example, sand, clay, wetlands, and possibly a considerable amount of water. Another conventional wood mat utilizes smaller dimensional lumber and utilizes nails, carriage bolts, or steel rods as a fastening system. All of these systems have mechanical fastening systems to transfer stresses between components. Additionally, U.S. Pat. No. 4,932,198 discloses a compound timber-metal stressed deck with metal plates inserted between the timbers.

The hardwood panels are typically discarded at the end of the construction project, or they may be re-used if they are in relatively good condition. The longevity of the panels may be as little as six months to one year, depending on the length of the construction project and the environmental conditions to which the panels are subjected. The wood panels are typically untreated with preservative chemicals because of environmental concerns. Hardwoods are typically used because of their superior wear resistance to heavy truck and other construction equipment traffic. In addition to road panels and crane mats, other applications for the hardwood panels include decks over steel girders for temporary bridges, and soldier piles.

Support mats are known to deflect or bend when a load is applied to an upper or load-bearing surface of the support mat. The vertical distance (perpendicular to the length of the wood members used in the support mat) that a support mat deflects will vary with the length of the support mat and the distribution of the load applied to the load-bearing surface of the support mat. A mat having a length of about 14 feet and a width of about 8 feet may, for example, deflect within the range of from about 2 inches to about 4 inches, although a mat may deflect less than 2 inches or more than 4 inches. Upon removal of the applied load, the support mat will return to a substantially planar shape.

Some support mats may be reinforced with steel or other metal beams. These steel beams are the same length as the mat and may be attached to the outboard edges of the support mat or at various intervals between the wood members that comprise the support mat. See for example support mats manufactured by Lister Industries Limited (http://www.listerindustries.com; accessed Aug. 23, 2012). The steel beams may provide additional strength to the support mat and reduce wear and tear on the wood members from handling, moving, etc. when the support mat is used in a field environment. Such a steel reinforced support mat will also deflect when a load is applied to an upper or load-bearing surface of the support mat. However, upon removal of the load, the steel reinforcement will not fully recover to its original shape and the support mat will experience a permanent deflection. Therefore, it would be desirable to provide an improved laminated support mat for supporting heavy equipment.

SUMMARY OF THE INVENTION

The present application describes various embodiments of a support mat. One embodiment of the support mat includes a plurality of vertically oriented individual wood members adhesively bonded to each other, each of the individual wood members having wide faces oriented parallel to a direction of a load applied to the support mat, the support mat having outboard wood members, the outwardly facing wide faces of the outboard wood members defining a wide face of the support mat. The support mat also includes least two protective edge members, each protective edge member having an inboard wide face, each of the at least two protective edge members positioned against one of the wide faces of the support mat. At least two substantially rigid fasteners extend through and connect each of the protective edge members and adjacent wood members. The wood members, protective edge members, and fasteners define a substantially rigid support mat having a substantially planar wide face.

Other advantages of the support mat will become apparent to those skilled in the art from the following detailed description, when read in view of the accompanying drawings.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figure 1:
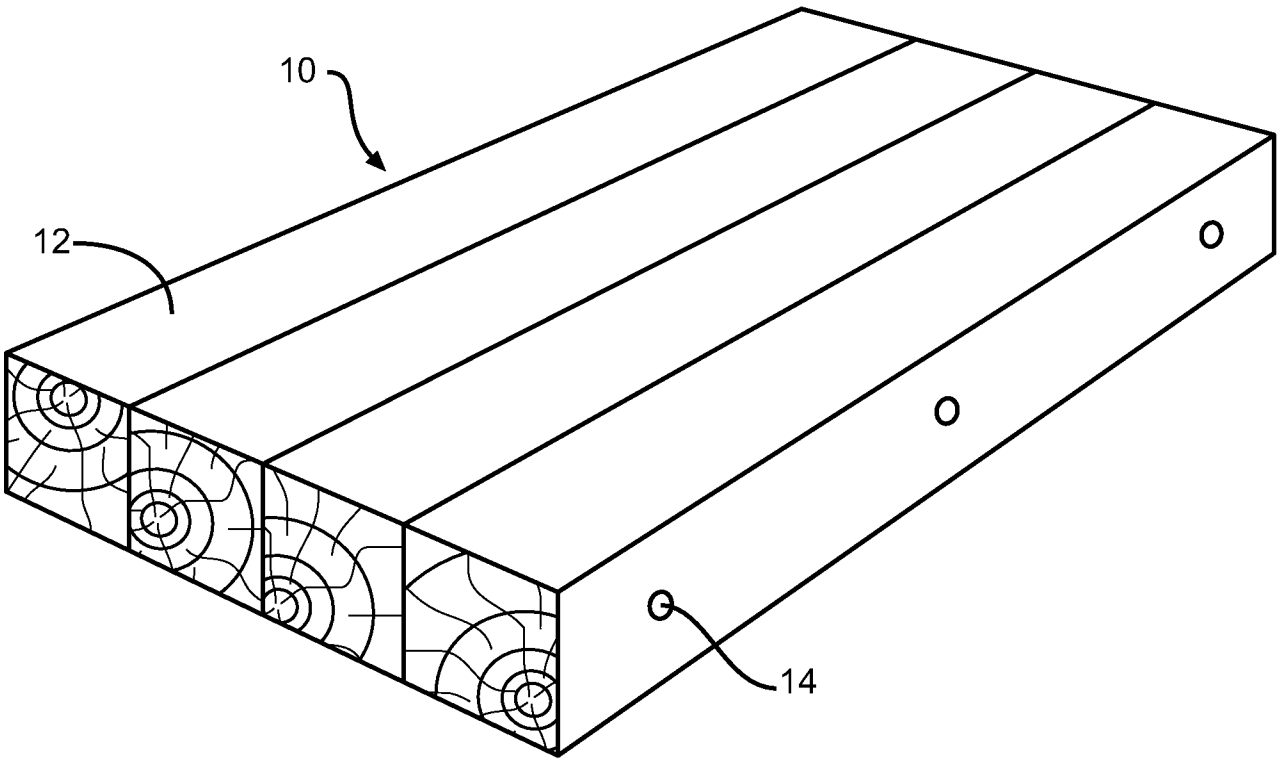
FIG. 1 (PRIOR ART)
FIG. 1 is a side perspective view of a prior art panel formed of solid sawn timber.
Figure 2:
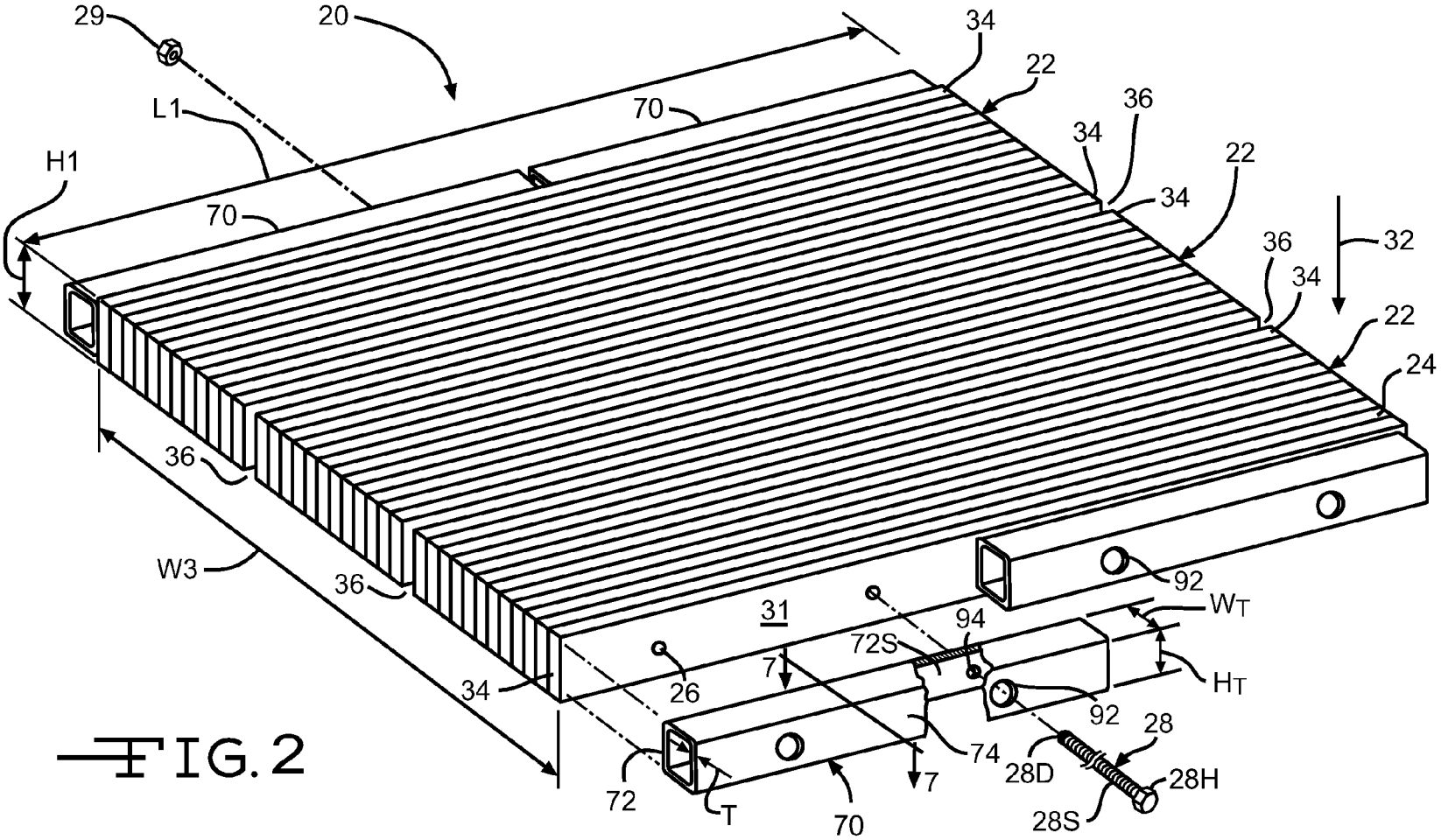
FIG. 2 is a partially exploded side perspective view of a first embodiment of a laminated support mat according to the invention.

Referring now to FIG. 2, a first embodiment of a laminated support mat is indicated generally at 20. The illustrated laminated support mat 20 is comprised of a plurality of laminated beams or billets 22 and has a substantially planar wide or load-bearing face 96.

Each of the illustrated billets 22 comprises a plurality of wood members or individual wood laminations 24. Apertures 26 may be formed through the laminated support mat 20 for receiving fastening means, such as the substantially rigid fasteners or bolts 28, as will be described in detail herein. As used in the description of the invention, the term "mat" includes mats as well as panels. Examples of such a support mat are described in co-assigned U.S. Pat. Nos. 7,137,226 and 7,818,929, herein incorporated by reference in their entirety.

The individual wood laminations 24 may be fabricated by structurally joining together arbitrary or different lengths or strips of wood or wood material. The arbitrary strips of wood material may be disposed end-to-end and joined together, such as by a jointing process. One example of such a jointing process is finger jointing. It will be understood that the strips may be continuous and full length. The arbitrary strips of wood may be strips of hardwood, such as oak, birch, or maple, although any desired hardwood or softwood may be used. The strips of wood laminations 24 may be any length, such as a length within the range of from about 5 feet to about 16 feet. The strips of wood material may be joined together to define the individual wood laminations 24 of any desired length, such as individual wood laminations having a length within the range of from about 12 feet to about 60 feet. It will be understood however, that the individual wood laminations 24 may be of any other desired length. Not all the wood laminations 24 need to be formed by joining together the strips, and the billet may be formed with some of the laminations formed by joined strips, and some of the wood laminations 24 being a continuous piece of full length wood. In one embodiment of the billet 22, at least 50 percent of the wood laminations are made of strips joined together.

Figure 3:
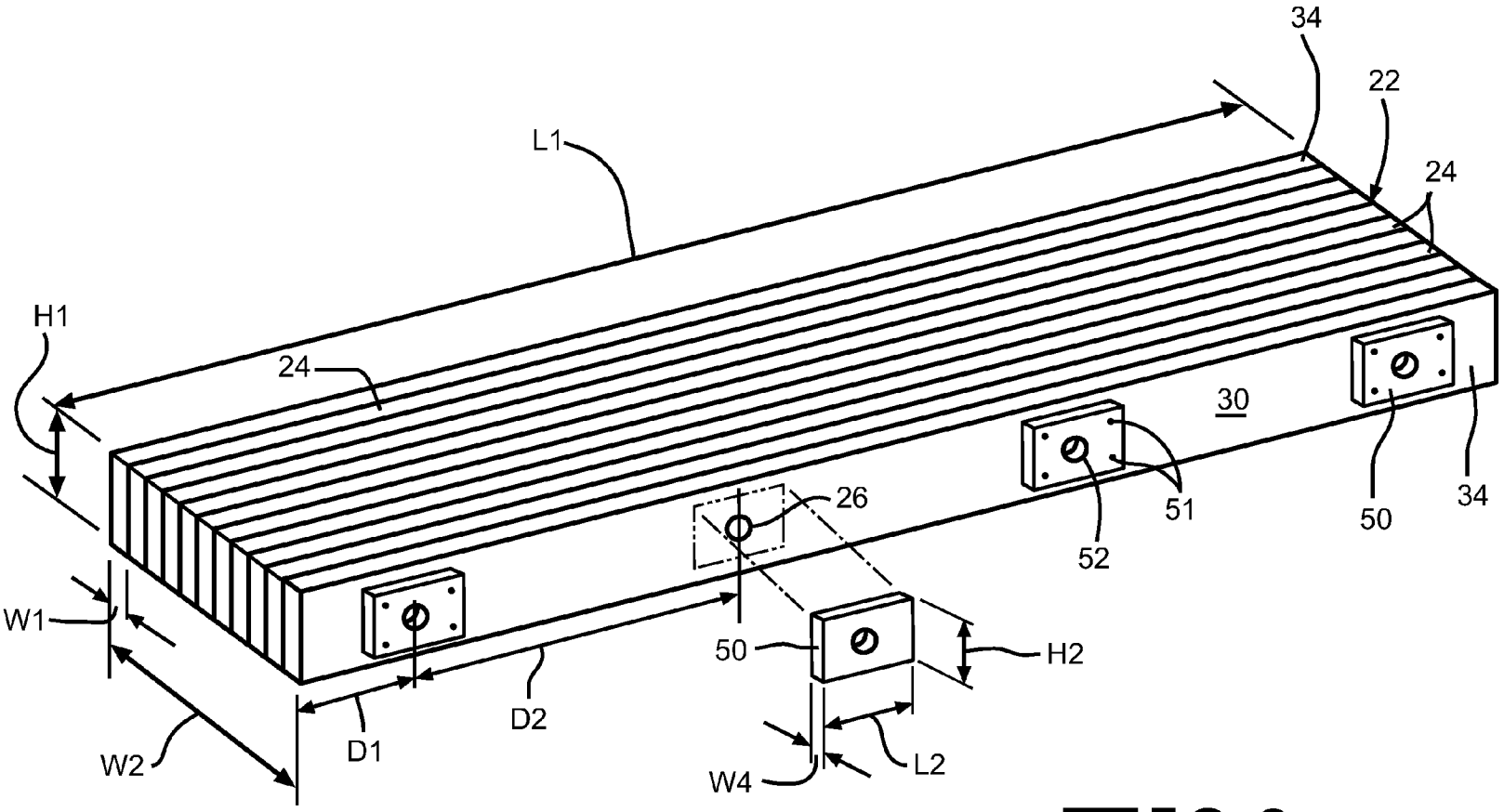
FIG. 3 is a partially exploded side perspective view of a billet illustrated in FIG. 2.

As best shown in FIG. 3, the individual wood laminations 24 have a thickness or height H1, a thickness or width W1, and a length L1. The laminations 24 may have any desired length L1. In the embodiment illustrated in FIGS. 2 and 3, the length L1 is about 8 feet. It will be understood however, that the laminations 24 may have any other desired length. The individual wood laminations 24 may have a height H1 within the range of from about 3 inches to about 6 inches. In the embodiment illustrated in FIGS. 2 and 3 the individual wood laminations 24 have a height H1 of about 5½ inches. The individual wood laminations 24 have a width W1 within the range of from about 0.50 inches to about 1.00 inches. In the embodiment illustrated in FIGS. 2 and 3 the individual wood laminations 24 have a width W1 of about ¾ inches. It will be understood however, that the individual wood laminations 24 may have any desired length L1, height H1, and width W1.

In the embodiment illustrated in FIG. 2, a plurality of the individual wood laminations 24 are joined together to form the laminated billets 22. The illustrated individual wood laminations 24 are vertically oriented, having a wide face 30 oriented parallel to a direction of a (load indicated by the arrow 32) applied to the laminated billet 22.

As best shown in FIG. 3, the laminated billet 22 has the height H1, the width W2, and the length L1. It will be understood that the laminated billet 22 may have any desired width W2. A typical laminated billet 22 may contain within the range of from about 14 laminations to about 16 laminations and have a width W2 of about 12 inches. In the illustrated embodiment, the length L1 of the laminated billets 22 is equal to the length L1 of the laminations 24, and the height H1 of the laminated billets 22 is equal to the height H1 of the laminations 24.

The individual wood laminations 24 may be joined together into the billet 22 using any desired adhesive. The individual wood laminations 24 may be joined together with a waterproof adhesive, such as an adhesive that conforms to ASTM D2559-01. Each billet 22 includes outboard laminations 34, as shown in FIG. 3. The wide faces of the outboard laminations 34 of each outboard billet 22, such as the wide face 30, define a wide face 31 of the billet 22.

As best shown in FIG. 2, the laminated support mat 20 includes elongated protective edge members 70. Each illustrated protective edge member 70 is formed of tubular steel having a substantially square transverse cross-section. The illustrated protective edge member 70 has a height $H_T$ of about 4.0 inches, a width $W_T$ of about 4.0 inches, and a wall thickness T of about 0.25 inches. The illustrated protective edge members 70 have an inboard wide face 72 and an outboard wide face 74. As shown in FIG. 2, the inboard wide face 72 of the protective edge member 70 is positioned against one the wide faces 31 of the laminated support mat 20.

It will be understood that the protective edge member 70 may have any height $H_T$ corresponding to the height H1 of the laminated support mat 20. For example, the height $H_T$ of the protective edge member 70 may be equal to or slightly less than the height H1 of the laminated support mat 20.

Alternatively, the protective edge member 70 may have any desired wall thickness T such as a wall thickness T within the range of from about 0.125 inches to about 0.5 inches. The protective edge member 70 may also have any other transverse cross-sectional shape, including but not limited to a substantially rectangular shape as shown at 76 in FIG. 8. The shape of the protective edge member 70 is not limited to a tubular shape and may include a solid substantially rectangular bar, as shown at 78 in FIG. 9. The protective edge member 70 may also have a substantially M-shaped transverse cross-sectional shape, as shown at 80 in FIG. 10. The M-shaped protective edge member 80 includes elongated outboard leg members 82, and elongated inboard leg members 84 which intersect at a central portion 86. The central portion 86 includes one or more apertures 88 through which a bolt 28 may be extended.

The protective edge member 70 may also be formed from material other than steel. Non-limiting examples of alternative material for the protective edge member 70 includes aluminum, plastic, composite materials, and other metal and non-metal material.

The protective edge member 70 may have any desired length L2. In the embodiment illustrated in FIGS. 2 and 3, the laminated billet 22 has a length L1 of about 8 feet and two protective edge members 70 are mounted to each outboard wide face 31 of the billet 22. The protective edge members 70 have at least two pairs of coaxially aligned apertures 90; each pair of apertures 90 including a first aperture 92 formed through the outboard wide face 74 and second aperture 94 formed through the inboard wide face 72. In the illustrated embodiment, the first aperture 92 is larger than the second aperture 94. Each pair of apertures 90 is structured such that the first aperture 92 is large enough that a head 28H of the bolt 28 may pass through the aperture 92, and the second aperture 94 is only large enough that a shaft 28S, but not the head 28H, of the bolt 28 may pass through the aperture 94. Allowing the head 28H of the bolt 28 to engage an inside surface 72S of the inboard wide face 72, ensures that the inboard wide face 72 will be firmly pressed into contact with the outboard wide face 31 of the billet 22 when the bolt 28 is tightened.

Each of the protective edge members 70 has a length L2 slightly less than 4.0 feet, such as about 47.875 inches. Alternatively, the protective edge members 70 may have a length L2 a within the range of from about 47.5 inches to about 47.875 inches. Additionally, the protective edge members 70 may have a length L2 less than about 47.5 inches. The protective edge members 70 may be attached to one or more billets 22 by any suitable means to form the laminated support mat 20. In the embodiment illustrated in FIG. 2, a plurality of billets 22 is assembled together with fasteners, such as the bolts 28. The bolts 28 extend through each pair of apertures 90 in the protective edge members 70 and the bolt apertures 26 in the laminated billets 22. Each bolt 28 is inserted through the first aperture 92, such that the head 28H engages an inside surface of the inboard wide face 72. A nut 29 is attached to a distal end 28D of the bolt and also engages an inside surface of the inboard wide face 72 of an opposite protective edge member 70 and securely tightened, thus ensuring that the inboard wide faces 72 of each protective edge member 70 will be firmly pressed into contact with respective outboard wide face 31 of the billets 22. When the protective edge members 70 and billets 22 are attached to form the laminated support mat 20 as described above, the edge members 70 are in an initial position, as best shown in FIGS. 2 and 6A.

It will be understood that any other desired fastener may be used. Adhesive, binding wire, shear connections, or brackets, all not shown, may also be used to connect the protective edge members 70 and laminated billets 22 together to form the laminated support mat 20. These mechanical fastening systems allow stresses to be transferred between components. Adhesive may also be used in conjunction with a mechanical fastening system.

Figure 6A:
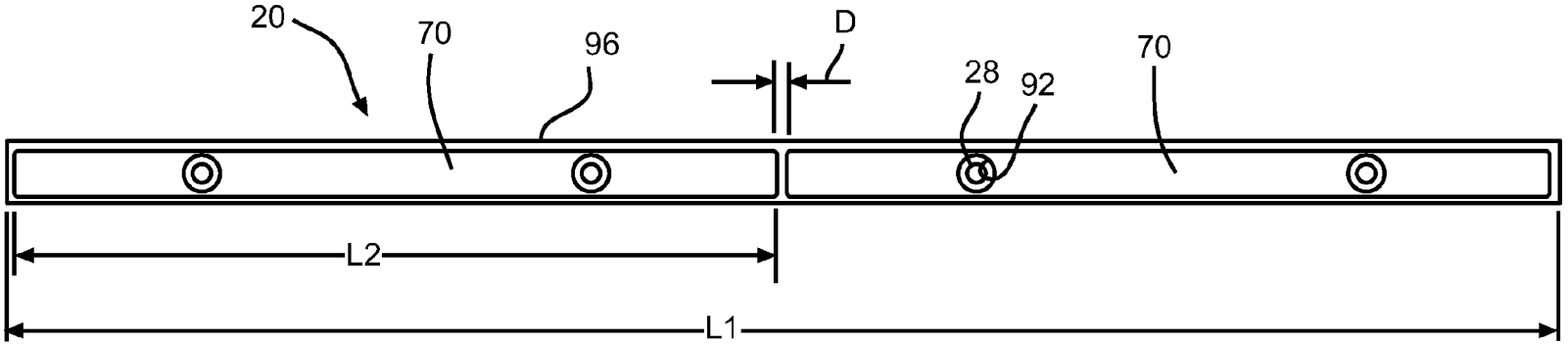
FIG. 6A is a side elevational view of the laminated support mat illustrated in FIG. 2.
Figure 6B:
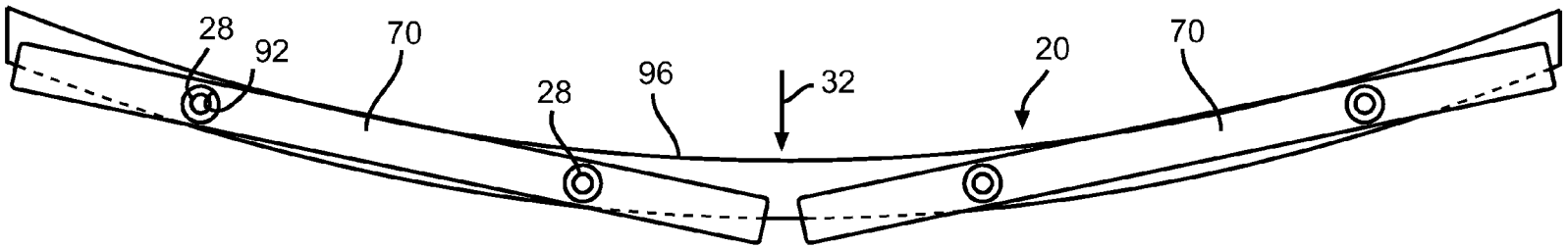
FIG. 6B is as side elevational view of the laminated support mat illustrated in FIG. 6A after a load has been applied.

As best shown in FIG. 6A, the adjacent protective edge members 70 are longitudinally spaced apart by a minimum distance D that is long enough such that when the laminated support mat 20 bends in response to a load 32 on its load-bearing face 96, as shown in FIG. 6B, each protective edge member 70 pivots about each of the two bolts 28.

Advantageously, the pivoting movement of the protective edge members 70 about each of the two bolts 28 prevents a bending moment being imparted on the protective edge members 70. Thus, when the load 32 is removed from the laminated support mat 20, each protective edge member 70 pivots about each of the two bolts 28, and returns to the initial position, as shown in FIG. 6A. Further, the minimum distance D between the adjacent protective edge members 70 is long enough such that when the laminated support mat 20 bends in response to the load 32 on its load-bearing face 96, the adjacent protective edge members 70 do not touch one another at any time during bending of the support mat, such as shown in FIG. 6A. Alternatively, the protective edge members 70 may be configured such that the adjacent protective edge members 70 may touch one another at extreme bending of the support mat.

FIGS. 2, 6A, and 6B illustrate a laminated support mat 20 having a length L1 of 8 feet and two protective edge members 70, each having a length L2 of slightly less than 4.0 feet. It will be understood that other lengths of protective edge members may be provided on laminated support mats having lengths other than 8 feet.

Figures 7, 8, 9, 10, 11, 12:
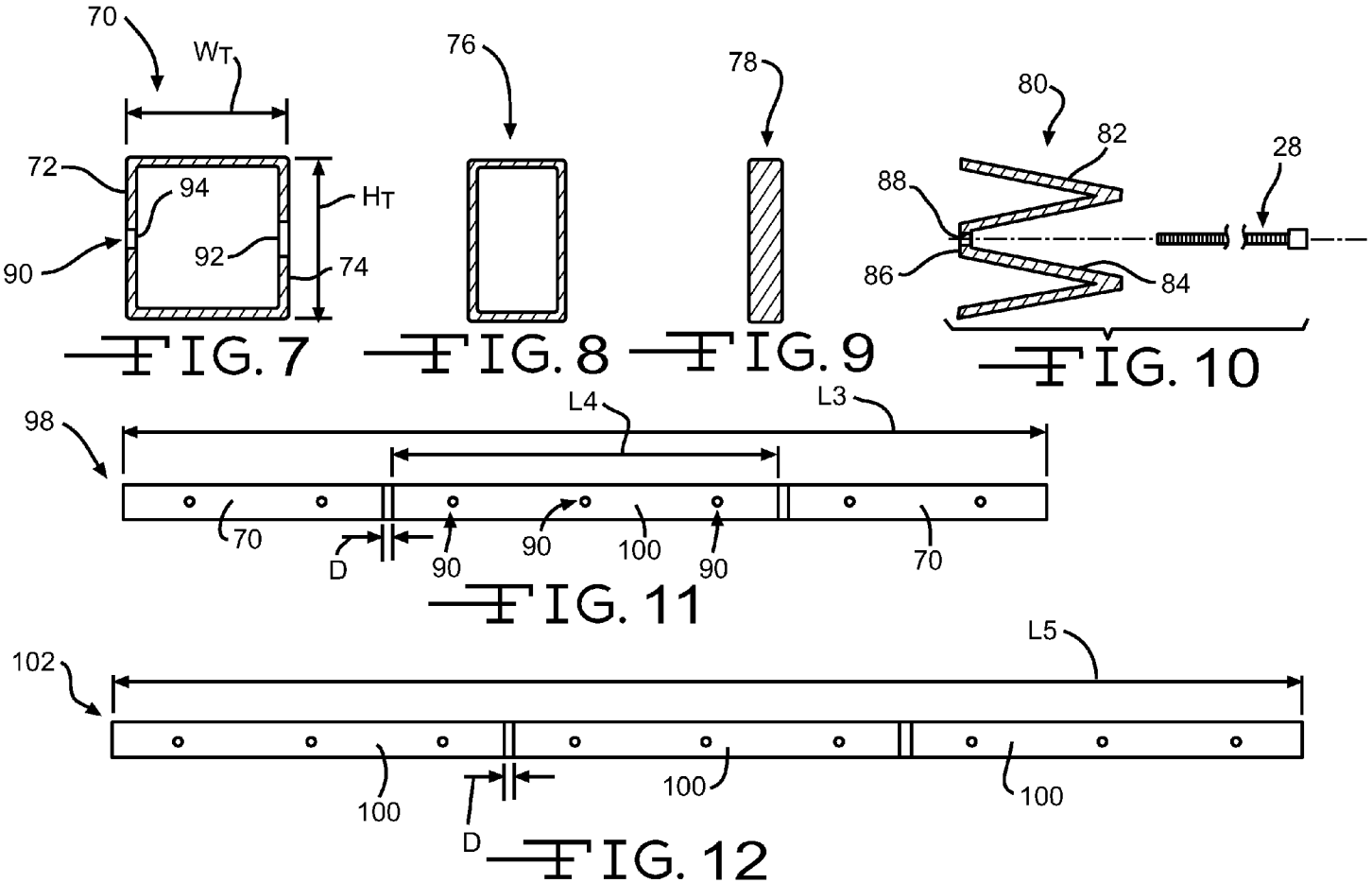
FIG. 7 is a cross-sectional view of the protective edge member taken along the line 7-7 in FIG. 2.
FIG. 8 is a cross-sectional view of a second embodiment of the protective edge member.
FIG. 9 is a cross-sectional view of a third embodiment of the protective edge member.
FIG. 10 is a cross-sectional view of a fourth embodiment of the protective edge member.
FIG. 11 is a side elevational view of a second embodiment of the laminated support mat.
FIG. 12 is a side elevational view of a third embodiment of the laminated support mat.

One example of such an alternative embodiment is illustrated in FIG. 11 wherein a second embodiment of a laminated support mat is shown at 98. The laminated support mat 98 has a length L3 of about 14 feet. The laminated support mat 98 includes three protective edge members. The outboard protective edge members (to the left and right when viewing FIG. 11) are the protective edge members 70 described in detail above. The centrally mounted protective edge member 100 is substantially similar to the protective edge members 70, but has a length L4 of slightly less than 6.0 feet, such as about 71.875 inches, and has three pairs of apertures 90. Alternatively, the protective edge members 70 may have a length L4 a within the range of from about 71.5 inches to about 71.875 inches. Additionally, the protective edge members 70 may have a length L4 less than about 71.5 inches.

Another example of such an alternative embodiment is illustrated in FIG. 12 wherein a third embodiment of a laminated support mat is shown at 102. The laminated support mat 102 has a length L5 of about 18 feet. The laminated support mat 102 includes three of the protective edge members 100 described in detail above.

Figure 4:
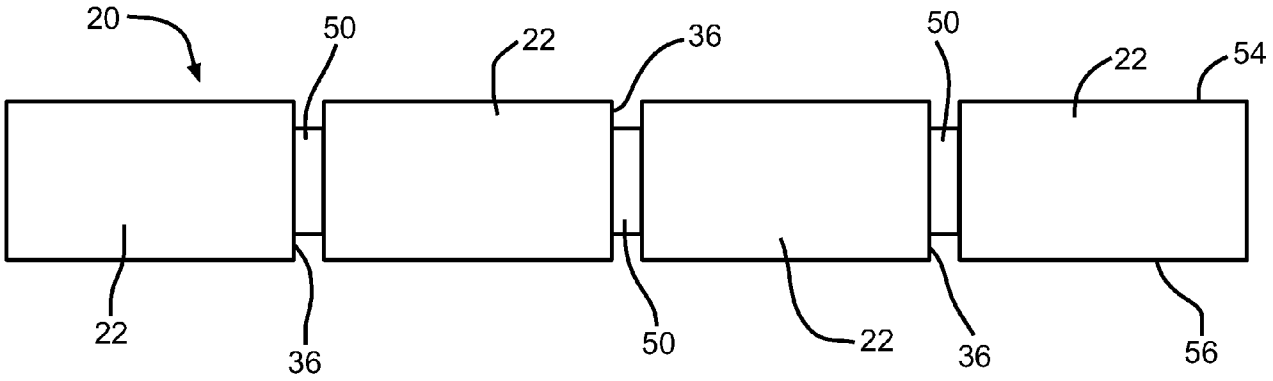
FIG. 4 is a schematic end view of the laminated support mat illustrated in FIG. 2.

In the embodiments illustrated in FIGS. 2 and 4, a plurality of laminated billets 22 is attached to one another to form the laminated support mat 20. In the illustrated embodiment, the wide faces 30 of the outboard laminations 34 of adjacent billets 22 are disposed such that a space 36, the purpose of which will be described in detail below, is defined between the adjacent billets 22. The three laminated billets 22 illustrated in FIG. 2 further define a width W3 for the entire laminated support mat 20. It will be understood that the laminated support mat 20 may have any desired width W3. As best shown in FIG. 2, the laminated support mat 20 also has a height H1 and a length L1. It will be understood that the laminated support mat 20 may have any desired height H1 and length L1.

Figure 5:
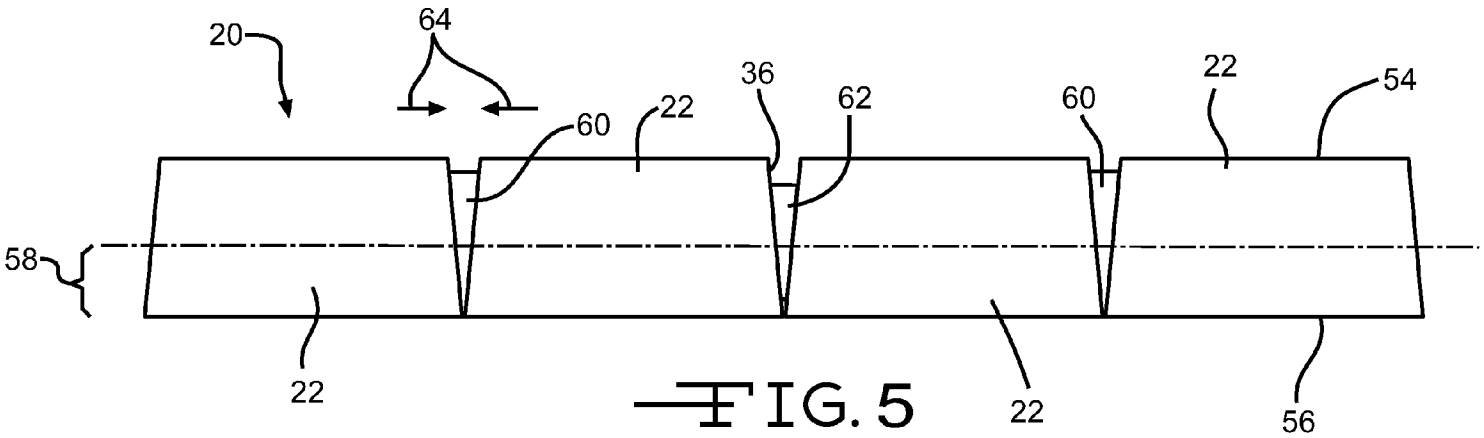
FIG. 5 is a schematic end view of the laminated support mat illustrated in FIGS. 2 and 4, showing the laminated support mat after expansion.

Although the embodiment illustrated in FIG. 2 includes three billets 22 and the embodiment illustrated in FIGS. 4 and 5 include four billets 22, it will be understood that any desired number of laminated billets 22 may be attached to one another to form the laminated support mat 20. Also, the laminated billets 22 need not all be of the same width W2, but may be of different widths W2. Non-limiting examples of suitable mat widths W3 include widths of 4 feet and 8 feet.

Although the billets 22 are shown as having individual wood laminations 24 of a generally uniform width W1, it will be understood that the billets 22 may be made of individual wood laminations 24 that vary in thickness across the width W2 of the billet 22. Also, it will be understood that the billets 22 on the outboard sides the mat 20 need not be identical to each other or to the billet or billets 22 in the central portion of the mat 20.

Referring again to FIG. 3, an embodiment of an expansion pad is indicated generally at 50. In the illustrated embodiment, a plurality of the expansion pads 50 is shown disposed on the wide faces 30 of the outboard laminations 34, and within the space 36 between adjacent billets 22. It will be understood that any number of pads 50 may be disposed within the space 36 between adjacent billets 22, such as for example, one pad 50.

The plurality of expansion pads 50 may be positioned having any desired distance between adjacent pads 50. In the illustrated embodiment, a center 52 of the left and right-most expansion pads 50 are spaced a distance D1 from the longitudinal ends of the billet 22, and a center 52 of each remaining expansion pad 50 is spaced a distance D2 from the center 52 of an adjacent expansion pad 50. In the illustrated embodiment, the distance D1 is about 12 inches and the distance D2 is about 24 inches. Alternatively, the expansion pads 50 may be spaced at any desired distance from one another. If desired, the pads 50 may be secured by any suitable means to the wide faces 30 of the outboard laminations 34 prior to the billets 22 being assembled together with the bolts 28. Examples of suitable means to secure the pads 50 to the wide faces 30 of the outboard laminations 34 include staples 51, nails, adhesive, and the like.

In the illustrated embodiments, the pads 50 are positioned such that the bolts 28 extend through an aperture at the center 52 of the pads 50. It will be understood that the mat 20 may be assembled such that the bolts 28 extend through any desired number of the pads 50, extend through only a portion of the pads 50, or do not extend through any pads 50.

The expansion pad 50 may have any desired thickness or width W4. In one embodiment of the expansion pad 50, the pad 50 has a width W4 within the range of from about 0.375 inches to about 0.625 inches. In another embodiment of the pad 50, the pad 50 has a width W4 of about 0.375 inches.

The expansion pad 50 may have any desired length L2. In one embodiment of the expansion pad 50, the pad 50 has a length L2 within the range of from about 3 inches to about 12 inches. In another embodiment of the pad 50, the pad 50 has maximum length L2 of about 12 inches.

The expansion pad 50 may have any desired height H2. In one embodiment of the expansion pad 50, the pad 50 has a height H2 within the range of about 70 percent to about 80 percent of the height H1 of the wide face 30 of the billet 22. In another embodiment of the pad 50, the pad 50 has a height H2 of about 75 percent of the height H1 of the wide face 30 of the billet 22.

The expansion pad 50 may be formed from any desired material having the properties of good mechanical strength, high ozone and weather resistance, good aging resistance, low flammability, good resistance toward chemicals, moderate oil and fuel resistance, and adhesion to many substrates. One embodiment of a material for the expansion pad 50 has a shore A hardness (shore A hardness is the relative hardness of elastic materials, typically determined with a Shore A durometer) within the range of from about 40 to about 50, an elongation at rupture within the range of from about 100 percent to about 70 percent, and a moderate resistance to weathering, ozone, gas, diesel, mineral oil, and hydraulic fluid. Examples of suitable materials for the expansion pad 50 include chloroprene or polychloroprene (CR) rubber, and natural rubber.

In the embodiment illustrated in FIG. 4, the laminated support mat 20 is substantially symmetrical and includes a first support surface 54 (upwardly facing as viewed in FIG. 4) and a second support surface 56 (downwardly facing as viewed in FIG. 4) opposite the first support surface 54. Each of the first and second support surfaces 54 and 56 define a substantially flat surface. Accordingly, either of the first and second support surfaces 54 and 56 may be placed against a surface, such as the ground, at a construction site. The other of the first and second support surfaces 54 and 56 thereby faces upwardly to support objects, such as vehicles, equipment, and the like.

When only a portion of the laminated support mat 20, such as a region 58 adjacent only one support surface (such as the second support surface 56 illustrated in FIG. 5) experiences prolonged exposure to water or other moisture over a period of time, swelling or expansion of the laminated support mat 20 may occur asymmetrically. As a result of such asymmetrical expansion, the region 58 adjacent only one support surface (the second support surface 56 in the illustrated embodiment) expands substantially as shown in FIG. 5. It will be understood that the period of time that the laminated support mat 20 must be exposed water or other moisture before the illustrated expansion occurs may vary based on the type of wood and/or laminates used and the environmental conditions extant at the site the mat 20 is used. Typically, such expansion of the region 58 may occur after the region 58 of the mat 20 has been continuously submerged in water for within the range of from about two weeks to about 3 weeks.

The expansion pads 50, disposed between each adjacent billet 22, permit the asymmetrical expansion of the billets 22 in the region 58, while preventing the laminated support mat 20 from undesirably cupping and/or buckling and thereby allowing the first and second support surfaces 54 and 56 to remain substantially flat. As the region 58 of the billets 22 expand, the pads 50 are compressed inwardly (as indicated by the arrows 64 in FIG. 5) such that portions of the pad 50 are caused to extend upwardly and downwardly (as viewed in FIG. 5). The pads 50 may extend upwardly and downwardly substantially to or near the first and second support surfaces 54 and 56, as shown at 60 in FIG. 5. Alternatively, portions of the pad 50 may be caused to extend upwardly and downwardly (as viewed in FIG. 5) through only a portion of the distance to the first and second support surfaces 54 and 56, as shown at 62 in FIG. 5.

The principle and mode of operation of the laminated support mat and its method of manufacture have been described in its various embodiments. However, it should be noted that the laminated support mat and its method of manufacture described herein may be practiced otherwise than as specifically illustrated and described without departing from its scope.

What is claimed is:

1. A support mat comprising:

a plurality of vertically oriented individual wood members adhesively bonded to each other, each of the individual wood members having wide faces oriented parallel to a direction of a load applied to the support mat, the support mat having outboard wood members, the outwardly facing wide faces of the outboard wood members defining a wide face of the support mat;

at least two protective edge members, each protective edge member having an inboard wide face, the at least two protective edge members positioned against one the wide faces of the support mat; and at least two substantially rigid fasteners extending through and connecting each of the protective edge members and adjacent wood members;

wherein the wood members, protective edge members, and fasteners define a substantially rigid support mat having a substantially planar wide face; and wherein adjacent protective edge members are longitudinally spaced apart by a minimum distance long enough such that when the support mat bends in response to a load on its load-bearing face, each protective edge member is capable of pivoting about each of the at least two substantially rigid fasteners.

2. The support mat according to claim 1, wherein each protective edge member is formed of rigid material.

3. The support mat according to claim 2, wherein each protective edge member has a substantially square transverse cross-section.

4. The support mat according to claim 1, wherein each protective edge member has a substantially rectangular transverse cross-section.

5. The support mat according to claim 1, wherein each protective edge member has a substantially M-shaped transverse cross-section.

6. The support mat according to claim 1, wherein the protective edge members are equal in length.

7. The support mat according to claim 1, wherein a portion of the plurality of vertically oriented individual wood members define a billet, the support mat having a plurality of billets, each billet having outboard wood members, outwardly facing wide faces of the outboard wood members of each billet defining a wide face of the billet; and wherein an expansion pad is disposed between the wide faces of adjacent billets, the expansion pad permitting the asymmetrical expansion of the billets.

8. The support mat according to claim 1, wherein adjacent protective edge members are longitudinally spaced apart by a minimum distance long enough such that when the support mat bends in response to a load on its load-bearing face, adjacent protective edge members do not touch one another at any time during bending of the support mat.

9. The support mat according to claim 8, wherein each protective edge member is formed of rigid material.

10. The support mat according to claim 9, wherein each protective edge member has a substantially square transverse cross-section.

11. The support mat according to claim 8, wherein each protective edge member has a substantially rectangular transverse cross-section.

12. The support mat according to claim 8, wherein each protective edge member has a substantially M-shaped transverse cross-section.

13. The support mat according to claim 8, wherein the protective edge members are equal in length.

14. The support mat according to claim 8, wherein a portion of the plurality of vertically oriented individual wood members define a billet, the support mat having a plurality of billets, each billet having outboard wood members, outwardly facing wide faces of the outboard wood members of each billet defining a wide face of the billet; and wherein an expansion pad is disposed between the wide faces of adjacent billets, the expansion pad permitting the asymmetrical expansion of the billets.

15. A support mat comprising:

a plurality of billets fastened together, each billet comprising a plurality of vertically oriented individual wood members adhesively bonded to each other, each of the individual wood members having wide faces oriented parallel to a direction of a load applied to the support mat, each billet having outboard wood members, the support mat having outboard billets, the outwardly facing wide faces of the outboard wood members of each billet defining a wide face of the billet, a wide face of each outboard billet defining a wide face of the support mat;

at least two protective edge members, each protective edge member having an inboard wide face, the at least two protective edge members positioned against one of the wide faces of the support mat; and at least two substantially rigid fasteners extending through and connecting each of the protective edge members and adjacent billets;

wherein the billets, protective edge members, and fasteners define a substantially rigid support mat having a substantially planar wide face; and wherein adjacent protective edge members are longitudinally spaced apart by a minimum distance long enough such that when the support mat bends in response to a load on its load-bearing face, each protective edge member is capable of pivoting about each of the at least two substantially rigid fasteners.

16. The support mat according to claim 15, wherein adjacent protective edge members are longitudinally spaced apart by a minimum distance long enough such that when the support mat bends in response to a load on its load-bearing face, adjacent protective edge members do not touch one another at any time during bending of the support mat.

17. The support mat according to claim 15, wherein adjacent protective edge members are longitudinally spaced apart by a minimum distance long enough such that when the support mat bends in response to a load on its load-bearing face, adjacent protective edge members are configured to rotate relative to each other.

18. The support mat according to claim 15, wherein an expansion pad is disposed between the wide faces of adjacent billets, the expansion pad permitting the asymmetrical expansion of the billets.

* * * * *